US006071631A

United States Patent [19]

Takahata

[11] Patent Number: 6,071,631

[45] **Date of Patent: *Jun. 6, 2000**

[54] HEAT-RESISTANT AND ANTICORROSIVE LAMELLAR METAL-PLATED STEEL MATERIAL WITH UNIFORM PROCESSABILITY AND ANTICORROSIVENESS

[75] Inventor: Seiya Takahata, Mishima, Japan

[73] Assignee: Usui Kokusai Sangyo Kaisha Limited, Shizuoka Prefecture, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/979,483

[22] Filed: Nov. 26, 1997

Related U.S. Application Data

[63] Continuation of application No. 08/557,564, Nov. 14, 1995, abandoned.

[30] Foreign Application Priority Data

Nov. 14, 1994 [JP] Japan ..... 6-304287

[51] Int. Cl.[7] ..... B32B 15/18

[52] U.S. Cl. ..... 428/658; 428/659; 428/679; 428/935; 428/632

[58] Field of Search ..... 428/658, 659, 428/615, 632, 678, 679, 935; 205/176, 177, 246

[56] References Cited

U.S. PATENT DOCUMENTS

| | | | |
|---|---|---|---|
| 3,914,161 | 10/1975 | Yonezawa et al. | 204/44 |
| 4,224,115 | 9/1980 | Nara et al. | 204/15 |
| 4,282,073 | 8/1981 | Hirt et al. | 205/176 |
| 4,416,737 | 11/1983 | Austin et al. | 204/28 |
| 4,591,416 | 5/1986 | Kamitani et al. | 205/176 |
| 4,814,049 | 3/1989 | Helton et al. | 204/44.2 |
| 4,837,090 | 6/1989 | Hyner et al. | 428/626 |
| 4,889,602 | 12/1989 | Oshima et al. | 204/38.1 |
| 4,940,639 | 7/1990 | Ohshima et al. | 428/659 |
| 4,952,249 | 8/1990 | Dambre | 428/607 |
| 4,969,980 | 11/1990 | Yoshioka et al. | 204/28 |
| 5,059,493 | 10/1991 | Takahata | 428/658 |
| 5,266,182 | 11/1993 | Muko et al. | 205/246 |
| 5,275,892 | 1/1994 | Hyner et al. | 428/648 |
| 5,330,850 | 7/1994 | Suzuki et al. | 428/623 |
| 5,366,567 | 11/1994 | Ogino et al. | 148/258 |
| 5,422,192 | 6/1995 | Takahashi et al. | 428/632 |

*Primary Examiner*—John J. Zimmerman
*Attorney, Agent, or Firm*—Nikaido Marmelstein Murray & Oram, LLP.

[57] ABSTRACT

The present invention has for its object to obtain a heat-resistant and anticorrosive multilayer metal-plated steel object which excels in the uniformity of high-efficiency processability and anticorrosiveness. The steel object provided by the present invention to achieve such object comprises a steel substrate, a Ni-layer plated over the surface of the steel substrate to a thickness of 0.2–10 μm, a first Zn/Ni alloy layer plated over the Ni-layer to a thickness of 1–15 μm from an acid bath, such as a chloride bath or sulfuric acid bath, with the Ni-content of the first layer being in the range of 2–20% by weight and a second Zn/Ni alloy layer plated over the first Zn/Ni alloy layer to a thickness of 1–10 μm from an alkaline bath, with the Ni-content thereof being in the range of 2–20% by weight.

9 Claims, 3 Drawing Sheets

HEAT-RESISTANT AND ANTICORROSIVE LAMELLAR METAL-PLATED STEEL MATERIAL WITH UNIFORM PROCESSABILITY AND ANTICORROSIVENESS

This application is a continuation of application Ser. No. 08,557,564 filed Nov. 14, 1995 now abandoned.

BACKGROUND OF THE INVENTION

1. Field of the Invention

The present invention relates to heat-resistant and anticorrosive steel materials such as plates, pipes, joints, clamps, bolts, nuts and etc. which are covered with a plurality of metal-plated layers and which excels in the uniformity of processability and anticorrosiveness.

2. Description of the Prior Art

Heretofore, it has been usual that steel materials used as plates, pipes, joints, clamps, bolts, nuts and etc. used for automobiles and other various kinds of mechanical apparatuses are often plated with Zn to form a Zn-plated surface and then a chromate film is formed to cover the Zn-plated surface.

However, since a higher degree of anticorrosiveness has come to be required of these steel materials, especially for automobiles, the formation of only a Zn-plated layer has been found insufficient with respect to anticorrosiveness and in order to improve the anticorrosiveness of these materials, alloy platings such as Sn/Zn, Zn/Ni and etc. or a combination of such metal-plated layers and the Zn-plated layer has come to be employed. Thus, in Japanese Laid-Open Patent Publication No.H2-120034 there is proposed a heat-resistant and anticorrosive multilayer metal-plated steel pipe having, on the outer surface thereof, a Ni-plated layer, a Zn/Ni alloy-plated layer and a chromate film in that order.

However, a single layer of Zn/Ni alloy plating has the problem of lacking heat-resistivity and anticorrosiveness and a single layer of Ni+Zn/Ni alloy has the problems that although it has a favorable degree of heat-resistivity and anticorrosiveness, when the steel material has a complicated three-dimensional configuration, an acid bath such as a chloride bath or sulfuric acid bath is used so that the resultant plated film lacks uniformity with the result that the thickness of the plated film at the end portions of the material becomes large which reduces the processability of the material, while the film thickness becomes small at concave portions which reduces anticorrosiveness. Further, the rate of eutectoid becomes high at the concave portions and so the formation of a chromate film representing coloring property or reactivity becomes worse thereby deteriorating the uniformity of the external appearance of the material as a whole. In addition, there is also a problem that where an alkaline bath is used, while the uniformity of the chromate film is favorable, the adhesion between Ni and Zn/Ni reduces upon bending so that in a high temperature environment such as in the engine compartment of an automobile, insufficient processability and heat-resistivity of the material have been displayed so far.

SUMMARY OF THE INVENTION

The present invention has been made to solve the above-mentioned problems and an object of the invention is to obtain a multilayer metal-plated steel material having a heat-resistant property in addition to a higher degree of processability and anticorrosiveness.

The present inventor has so far conducted various kinds of investigations in order to solve the above-mentioned problems and to achieve the above-mentioned object, and as a result, he has completed the present invention by finding out that the object of the present invention can be achieved when a Ni-layer is first plated over a steel material, then a first Zn/Ni alloy layer is plated over the Ni-plated layer by using an acid bath, such as a chloride bath or a sulfuric acid bath, and finally, another Zn/Ni alloy first layer is plated over the Zn/Ni alloy layer by using an alkaline bath. That is, according to a first aspect of the present invention, there is provided a heat-resistant and anticorrosive metal-plated steel material comprising a basic steel material, a Ni-layer of a thickness of 0.2–10 μm plated over the surface of the base steel material, a first Zn/Ni alloy layer of a thickness of 1–15 μm plated over the Ni-plated layer by using an acid bath such as a chloride bath or a sulfuric acid bath with the Ni-content of the first layer being in a range of 2–20% and a second Zn/Ni alloy layer of a thickness of 1–10 μm plated over the first Zn/Ni alloy-plated layer by using an alkaline bath, with the Ni-content of the second layer being in the range of 5–10%. Further, according to a second aspect of the present invention, there is provided a heat-resistant and anticorrosive metal-plated steel material having uniform processability and anticorrosiveness, which comprises a basic steel material, a Ni-layer of a thickness of 0.2–10 μm plated over the surface of the basic steel material, a first Zn/Ni alloy layer of a thickness of 1–15 μm plated over the Ni-plated layer, by using an acid bath such as a chloride bath or a sulfuric acid bath, with the Ni-content of the first layer being in the range of 2–20%, a second Zn/Ni alloy layer of a thickness of 1–10 μm plated over the Zn/Ni-plated layer, by using an alkaline bath, with the Ni-content of the second layer being in the range of 2–20% and a chromate film plated over the second Zn/Ni alloy-plated layer. Further, according to the present invention, an acid bath, such as a chloride bath or a sulfuric acid bath, is used for forming on a Ni-plated layer, a Zn/Ni alloy layer, with the Ni-content of the first Zn/Ni layer being in the range of 12–15% and an alkaline bath is used for plating over the first Zn/Ni alloy-plated layer, another Zn/Ni alloy layer whose Ni-content is in the range of 5–10%.

DETAILED DESCRIPTION OF THE INVENTION

The basic materials used in the present invention are steel plates, joints, clamps, bolts and nuts and they may be covered with Cu-layers.

Further, to form the above-mentioned multilayer metal-plated structure, the known conventional methods may be used.

Moreover, the Ni-layer as the lowest layer has a thickness limitation of 0.2–10 μm because if the thickness of that layer is less than 0.2 μm, the ability to cover the basic steel material becomes inferior so that no marked improvement can be observed in the heat-resistivity and anticorrosiveness of the product while when the thickness exceeds the upper limit of 10 μm, there is the possibility that the Ni-layer will come off or crack upon bending so that no improvement in the anticorrosiveness can be expected from such a thickness increase. This Ni-plated layer is preferably formed by an electro-plating method and as a plating bath, a Watt bath is used so as to minimize the stress of the resultant plating layer with the thickness of the layer falling within the above-mentioned limitation range.

Next, a first Zn/Ni alloy layer, as an intermediate layer to be plated over the Ni-plated layer, is formed by the electro-plating method using a chloride bath or various kinds of known acid baths such as a sulfuric acid bath and in this case, the Ni-content of the first Zn/Ni layer is in the range of 2–20%, preferably 12–15%. From a point of view of anticorrosiveness, it is desirable to form the first Zn/Ni alloy layer by using an acid bath such as a chloride bath or a sulfuric acid bath although the anticorrosiveness of that layer principally depends on the composition of the plating bath being used and the plating current density. Further, the reason why the thickness of the first Zn/Ni alloy layer is in the range of 1–15 μm is that if the thickness is less than 1 μm, the covering ability of that layer becomes inferior so that the anticorrosiveness of the layer and the adhesiveness thereof with respect to another, later applied Zn/Ni alloy layer to be plated thereon can not be secured while when the thickness exceeds 15 μm, the thickness of the end portion of the layer becomes too large thereby lowering the processability thereof.

Moreover, the second Zn/Ni alloy layer to be plated over the first Zn/Ni alloy-plated layer, as an intermediate layer formed by using an acid bath, is formed by an electro-plating method using a known alkaline bath. The Ni content of this second layer is in the range of 2–20% but it is particularly preferable to set the Ni-content to a range of 5–10% from the point of view of the chromate film forming process to be later applied on that second layer. The thickness of the second layer in this case is in the range of 1–10 μm because if the thickness is less than 1 μm, the covering ability becomes inferior and lower the chromate film processability, while when the thickness exceeds 10 μm, the adhesiveness of the layer to the first Zn/Ni alloy layer, formed as a lower layer by using an acid bath, is lowered.

Further, the chromate film is formed on the second Zn/Ni alloy layer as an upper layer by using a processing liquid consisting of chromic acid or bichromic acid having sulfuric acid or hydrochloric acid added thereto, or a commercial chromate processing liquid conventionally used for Zn/Ni alloy plating.

Thus, it has been recognized that the multilayer metal-plated steel material according to the present invention excels in the uniformity of processability and anticorrosiveness, especially in a high temperature environment.

BRIEF DESCRIPTION OF THE DRAWINGS

The drawings illustrate a bent cathode method and a bending process used in the present invention wherein FIG. 1(*a*) is a cross-sectional view of a steel material before the steel material is subjected to multimetal plating.

PREFERRED EXAMPLES OF THE INVENTION

Preferred examples of the present invention will be described by referring to the accompanying drawings.

EXAMPLE 1

A SPCC steel plate having a thickness of 0.3 mm and formed to the size and shape shown in FIGS. 1(*a*) and 1(*b*) was used as a basic material. First, a Ni-plated layer as a lower layer having a thickness of 2 μm was formed over the surface of the basic material by using a Watt bath at a liquid temperature of 52–57° C. and with a current density of 3 A/dm$^2$. Next, a Zn/Ni alloy layer as an intermediate layer having a thickness of 5 μm was plated over the Ni-plated layer by using an acid bath (chloride bath) with a solution consisting of 100 g/L, $ZnCl_2$, 130 g/l $NiCl_2.6H_2O$ and 200 g/L $NH_4Cl$ and having a pH value of 5.7. This treatment was conducted for 6 minutes at a liquid temperature of 34–36° C. with a current density of 3 A/dm$^2$.

Then, another Zn/Ni alloy layer having a thickness of 4 μm was plated over the above-described Zn/Ni alloy-plated layer by using an alkaline bath with a solution consisting of 10 g/L ZnO, 10 g/L $NiSO_4$, 130 g/L NaOH and 100 ml/L Ni—T (trade name sold by Nippon Hymen Kagaku Kabushiki Kaisha). The treatment was conducted for 15 minutes at a temperature of 24–26° C. with a current density of 4 A/dm$^2$. After that, a chromate film was plated over the last-mentioned Zn/Ni alloy-plated layer by immersing the material into a solution of ZNC-980 C (trade name) sold by Nippon Hyomen Kagaku Kabushiki Kaisha for 20 minutes at a temperature of 28–32° C. with a pH value of 2.0.

By the way, it should be noted that the thicknesses of the above-mentioned layers and those of layers in the following comparison examples 1 and 2 were measured at the portion "a" given in FIGS. 1(*a*) and 1(*b*).

Figure 1A:
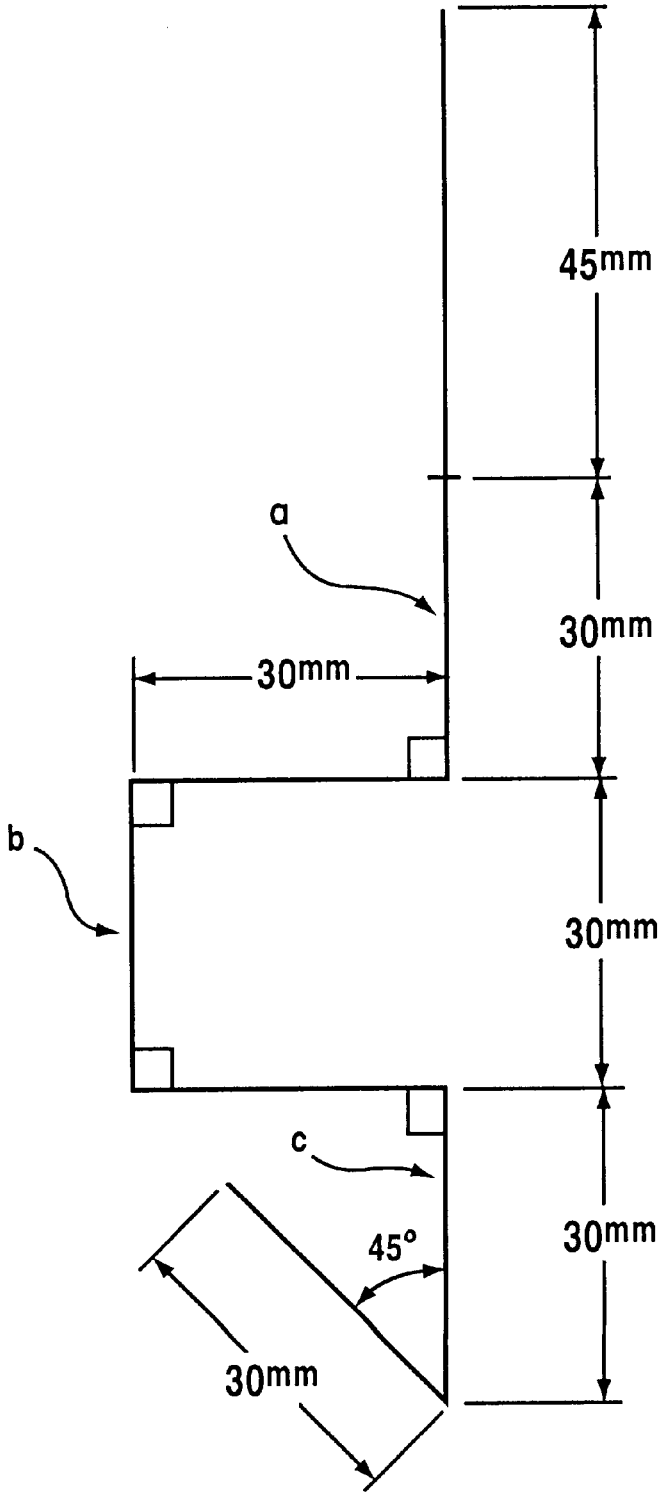
FIG. 1(*b*) is a front view of the steel material before multimetal plating.
Figure 1B:
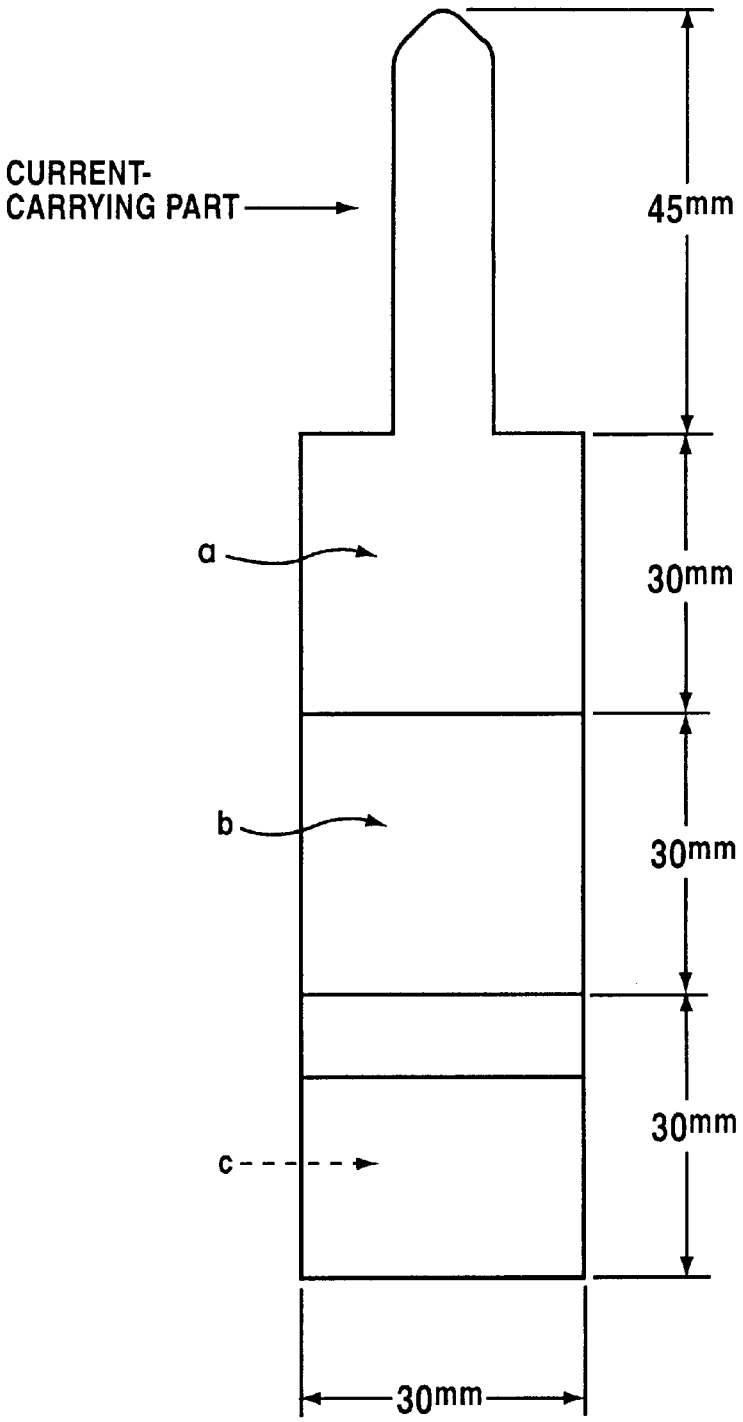
Figure 2:
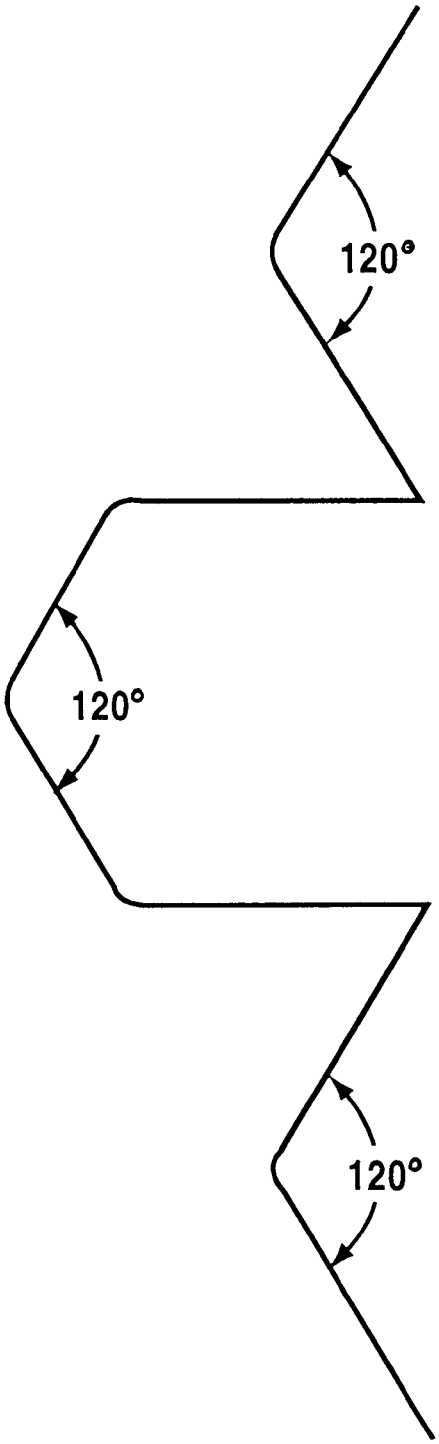
FIG. 2 is a cross sectional view illustrating a bending process to be performed after the steel material has been subjected to multimetal plating.

The lamellar metal-plated steel plated was then bent to a shape shown in FIG. 2 and the degrees of bending, elongation and adhesion of the steel plate were measured. After that, a salt spray test based on JIS Z 2371 was conducted on a non-heated sample of the steel plate and a sample thereof heated at a temperature of 120° C. for 24 hours so as to measure the anticorrosiveness of each of the samples at portions corresponding to those indicated by letters a, b and c of FIGS. 1(*a*) and 1(*b*) with favorable results shown in the table 1 given hereunder.

COMPARISON EXAMPLE 1

A steel material same in shape and kind as that used in the example 1 was plated with a Ni-layer of a thickness of 2 μm as a lower layer by using a Watt bath. Then a Zn/Ni alloy layer as an upper layer was plated over the Ni-layer to a thickness of 10 μm by using a chloride bath and finally a chromate film was formed over the Zn/Ni layer by immersing the material into a ZN-80YMU (trade name) sold by Ebara-Udylite Co., Ltd. at a temperature of 48–52° C. for 20 minutes keeping a pH value of 2.0. The product thus obtained was tested in the same manner as in the case of the example 1 with the results shown in the above-mentioned table 1.

COMPARISON EXAMPLE 2

A steel material same in shape and kind as that used in the example 1 was plated with a Ni-layer of a thickness of 2 μm as a lower layer by using a Watt bath. Then a Zn/Ni alloy layer as an upper layer was plated over the Ni-layer to a thickness of 11 μm by using an alkaline bath as in the case of the example 1 and finally, a chromate film was formed on the Zn/Ni layer in the same manner as in the case of the comparison example 1. The product thus obtained was then subjected to the same tests as conducted in the example 1 with the results shown in the table 1 below.

TABLE 1

| Plating | Position | Film thickness in μm Ni | Zn/Ni | Zn/Ni | Processability | Rust generating time (hr) non-heating | heating |
|---|---|---|---|---|---|---|---|
| Example 1 | a | 2 | 5 | 4 | good | 3000 | 2500 |
| | b | 3 | 10 | 6 | good | 3500 | 2500 |
| | c | 1 | 2 | 4 | good | 2500 | 2000 |
| Comparison | a | 2 | 11 | — | good | 3000 | 2500 |
| Example 1 | b | 3 | 21 | — | large crackings | 2000 | 1500 |
| | c | 1 | 4 | — | good | 1500 | 800 |
| Comparison | a | 2 | — | 9 | good | 2500 | 1500 |
| Example 2 | b | 3 | — | 12 | large crackings | 1500 | 500 |
| | c | 1 | — | 7 | good | 2000 | 1000 |

EXAMPLE 2

A multilayer metal-plated steel plate was obtained by using the same process as employed in the example 1 except that a Zn/Ni alloy layer as an intermediate layer was formed to a thickness of 6 μm layer by immersing the material into an acid bath (sulfuric acid bath) for seven minutes using a solution consisting of 150 g/L $ZnSO_4.7H_2O$, 300 g/L $NiSO_4.7H_2O$, 10 g/L $CH_3COONa.3H_2O$ and 5 g/L $C_6H_8O_7.H_2O$ with a pH value of 2.5 at a temperature of 50–55° C. and with a current density of 3 $A/dm^2$.

The processability of the product thus obtained was measured by using a bent cathode method with respect to the degree of bending, elongation and adhesion. Further, the spreading of each plated metal on the product at the portion c of FIGS. 1(*a*) and 1(*b*), the chromate film formability resulting from an unbalanced eutectoid rate, uniformity of anticorrosiveness of the entire surface of the product after bending and then heating the product (the anticorrosiveness of each of the portions a, b and c of the product after bending and heating), deposition velocity, cost per unit thickness of plating and easiness of control of each bath were observed and measured with the results shown in the table 2 hereinbelow.

COMPARISON EXAMPLE 3

A steel plate same in shape and kind as that used in the example 1 was used. First, a Ni-layer as a lower layer was plated over the steel plate to a thickness of 2 μm by using a Watt bath as in the case of the example 1 and then a Zn/Ni alloy layer as an upper layer was plated over the Ni-layer to a thickness of 8 μm by using the same sulfuric acid bath as in the case of the example 2. The product thus obtained was subjected to the same tests used in the example 2 with the results shown in the table 2 below.

COMPARISON EXAMPLE 4

A steel plate same in shape and kind as that used in the example 1 was used. First, a Ni-layer as a lower layer was plated over the steel plate to a thickness of 2 μm by using a Watt bath as in the case of the example 1 and a Zn/Ni alloy layer as an upper layer was plated over the Ni-layer to a thickness of 8 μm by using an alkaline bath as in the case of the example 1. The product thus obtained was subjected to the same tests used in the example 2 with the results shown in the table 2 below.

It should be noted that the thickness of each of the plated layers in the example 2 and the comparison examples 3 and 4 was at the portion a shown in FIGS. 1(*a*) and 1(*b*).

TABLE 2

| | | Example 2 | Comparison Example 3 | Comparison Example 4 |
|---|---|---|---|---|
| Lower layer thickness | Ni | 2 μm | 2 μm | 2 μm |
| Intermediate layer thickness (Acid bath) | Zn/Ni | 6 μm | 8 μm | — |
| Upper layer thickness (Alkaline bath) | Zn/Ni | 2 μm | — | 8 μm |
| Processability (at portion c shown in FIGS. 1(a) and 1(b)) | | 0 | 0 | Δ |
| Covering ability (at portion c shown in FIGS. 1(a) and 1(b)) | | 0 | x | 0 |
| Formability of chromate film | | 0 | x | 0 |
| Uniformity of anticorrosiveness after bending and heating | | 0 | Δ | x |
| Disposition velocity | | Δ | 0 | x |
| Cost (per unit thickness) | | Δ | 0 | Δ |
| Easiness of bath control | | Δ | Δ | 0 |

EXAMPLES 5–13 & COMPARISON EXAMPLES 5–10

A double steel pipe having a diameter of 8 mm, a thickness of 0.7 mm and a length of 330 mm was manufactured from a SPCC material having a deposited Cu-layer of about 3 μm formed at the time of manufacture. Then in examples 5–13 shown in the following table 3 the double steel pipe was subjected to multi-metal platings for forming a Ni-layer, a Zn/Ni alloy layer (by a chloride bath) and a Zn/Ni alloy layer (by an alkaline bath) in that order by the same procedures employed in the example 1 with each of the layers falling within the thickness ranges according to the present invention.

Likewise, a double steel pipe same in shape and kind as that used in the examples 5–13 was subjected to the same multi-metal platings in comparison examples 5–10 but in the comparison examples 5 and 6, the thickness of each of the Ni-layers as lower layers was outside the range of the present invention, in the comparison examples 7 and 8 the thickness of each of the Zn/Ni alloy layers (by an alkaline bath) as intermediate layers was outside the range of the present invention and in the comparison examples 9 and 10, the thickness of each of the Zn/Ni layers (by an alkaline bath) as upper layers was outside the range of the present invention.

Next, one end of each of the multi-plated steel pipes obtained in the examples according to the present invention and the comparison examples was bent by 180° with a radius of 25 mm to form a stick having a straight pipe portion of 200 mm in length. Then the stick was subjected to a salt spray test based on the JIS Z 2371 directly (i.e., without heating) or after heating it for 24 hours at a temperature of 120° C. and the time lapsed until any rust generates at the bent portion was measured with the results shown in the following table 3.

TABLE 3

| No. | Ni μm | Zn/Zi (Acid bath) μm | Zn/Ni (Alkaline bath) μm | Rust generating time at bent portion Non-heating | Heating |
|---|---|---|---|---|---|
| Examples | | | | | |
| 5 | 0.5 | 5 | 5 | 3000 | 2300 |
| 6 | 3 | 5 | 5 | 3000 | 2500 |
| 7 | 10 | 5 | 5 | 2600 | 2100 |
| 8 | 5 | 2 | 5 | 3300 | 2700 |
| 9 | 5 | 8 | 5 | 3500 | 3000 |
| 10 | 5 | 15 | 5 | 3500 | 3000 |
| 11 | 3 | 10 | 2 | 3300 | 2800 |
| 12 | 3 | 10 | 2 | 3500 | 3000 |
| 13 | 3 | 10 | 10 | 3000 | 2600 |
| Comparison Examples | | | | | |
| 5 | 0.1 | 5 | 5 | 2500 | 300 |
| 6 | 15 | 5 | 5 | 1200 | 700 |
| 7 | 3 | 0.5 | 5 | 1100 | 500 |
| 8 | 3 | 20 | 5 | 1700 | 1000 |
| 9 | 3 | 10 | 0.5 | 1200 | 700 |
| 10 | 3 | 10 | 15 | 1300 | 800 |

As will be clear from the table 3, the anticorrosiveness of each of the products in the comparison examples 5–10 is excessively inferior and it is especially so with respect to heating.

Further, although not illustrated herein, substantially the same results were obtained when a similar anticorrosion tests and a heat-resistance test were conducted on a seam welded pipe.

As described above, the multilayer metal-plated steel material according to the present invention comprises a Ni-layer of a certain thickness as a lower layer, a first Zn/Ni alloy layer as an intermediate layer plated over the Ni-layer by an acid bath, a second Zn/Ni alloy as an upper layer plated over the first Zn/Ni alloy layer by an alkaline bath and a chromate film formed over the second Zn/Ni alloy layer. Therefore, outstanding effects are recognized in that it excels in its processability such as bending, elongation and adhesion, the spreading of the plated metal to a portion not facing the electrode, the formability of the chromate film resulting from the unbalanced eutectoid rate, the uniformity of anticorrosiveness of the entire surface of the product, deposition velocity, cost per unit layer thickness and easiness of bath control, and particularly, it is suitable for use in a high-temperature environment since its anticorrosiveness does not deteriorate due to heating.

What is claimed is:

1. A steel material having, on the outer surface thereof, a Ni-layer having a thickness of 0.2 to 10 μm;

a first Zn/Ni alloy layer having a thickness of 1 to 15 μm disposed over the Ni-layer, wherein the first Zn/Ni alloy layer has been plated using an acid bath; and a second Zn/Ni alloy layer having a thickness of 1 to 10 μm disposed over the first Zn/Ni alloy layer, wherein the second Zn/Ni alloy layer has been plated using an alkaline bath.

2. The steel material according to claim 1, wherein the Ni-layer is formed by electro-plating using a Watt bath.

3. The steel material according to claim 1, wherein the first Zn/Ni alloy layer is formed by electro-plating using a chloride bath or a sulfuric acid bath.

4. The steel material according to claim 1, wherein the second Zn/Ni alloy layer is formed by electro-plating.

5. A steel material having, on the outer surface thereof, a Ni-layer having a thickness of 0.2 to 10 μm;

a first Zn/Ni alloy layer having a thickness of 1 to 15 μm disposed over the Ni-layer, wherein the first Zn/Ni alloy layer has been plated using an acid bath;

a second Zn/Ni alloy layer having a thickness of 1 to 10 μm disposed over the first Zn/Ni alloy layer, wherein the second Zn/Ni alloy layer has been plated using an alkaline bath; and a chromate film plated over the second alloy layer.

6. The steel material according to claim 5, wherein the Ni-layer is formed by electro-plating using a Watt bath.

7. The steel material according to claim 5, wherein the first Zn/Ni alloy layer is formed by electro-plating using a chloride bath or a sulfuric acid bath.

8. The steel material according to claim 5, wherein the second Zn/Ni alloy layer is formed by electro-plating.

9. The steel material according to claim 5, wherein the chromate film is deposited from a processing liquid consisting essentially of chromic acid or dichromic acid and sulfuric acid or hydrochloric acid.

* * * * *